US005806270A

United States Patent [19]

Solano et al.

[11] Patent Number: 5,806,270

[45] Date of Patent: Sep. 15, 1998

[54] METHOD OF FLOOR CONSTRUCTION WITH A GRID SYSTEM

[76] Inventors: Albert Solano, 804 Aspen Cir.; Jason Solano, 924 Aspen Cir., both of Pueblo, Colo. 81006

[21] Appl. No.: 755,360

[22] Filed: Nov. 25, 1996

Related U.S. Application Data

[63] Continuation-in-part of Ser. No. 659,333, Jun. 6, 1996, abandoned.

[51] Int. Cl.[6] ..... E04B 5/00; E04G 21/16

[52] U.S. Cl. ..... 52/747.11; 52/181; 52/385; 52/396.1; 52/403.1; 52/460; 52/468; 52/506.01; 52/749.11

[58] Field of Search ..... 52/311.1, 312, 52/177, 181, 384, 385, 387, 390, 396.1, 403.1, 459, 460, 468, 480, 506.01, 506.05, 745.06, 745.13, 747.1, 747.11, 747.12, 749.11, 749.15

[56] References Cited

U.S. PATENT DOCUMENTS

| | | | |
|---|---|---|---|
| 421,742 | 2/1890 | Marsh | 52/387 |
| 903,183 | 11/1908 | Eggers | 52/387 |
| 1,836,964 | 12/1931 | Grigsby et al. | 52/387 |
| 1,890,954 | 12/1932 | Snyder | 52/390 X |
| 1,913,290 | 6/1933 | Rockwell | 52/396.1 |
| 2,852,932 | 9/1958 | Cable | 52/385 |
| 3,375,633 | 4/1968 | Pourtau | 52/390 X |
| 4,409,269 | 10/1983 | Gardner | 52/384 X |
| 4,694,627 | 9/1987 | Omholt | 52/390 |
| 4,744,194 | 5/1988 | Yasuyoshi | 52/747.11 |
| 4,761,926 | 8/1988 | Rea et al. | 52/387 |
| 4,862,668 | 9/1989 | DeGooyer | 52/747.11 |
| 5,155,952 | 10/1992 | Herwegh et al. | 52/312 X |
| 5,447,004 | 9/1995 | Vrnak | 52/387 |

*Primary Examiner*—Carl D. Friedman
*Assistant Examiner*—Kevin D. Wilkens
*Attorney, Agent, or Firm*—Phillip A. Rein

[57] ABSTRACT

A method of floor construction with a grid system utilizing 1) a plurality of floor grid members interconnected to create a floor grid member assembly; 2) a plurality of floor tile members mounted on respective ones of the floor grid members; 3) a plurality of cushion pad members having one associated with each respective floor tile member; 4) grout strip members mounted within grout receiving grooves in the floor grid members and about the floor tile members; and 5) a tile setter tool member is used to mount a floor tile member between the grout strip members. The method of floor construction includes 1) installing a basic support flooring; 2) laying out a plurality of floor grid members on the basic support flooring; 3) interlocking the floor grid members; 4) moving the interlocked floor grid members to minilize the number of floor grid members needed; 5) cutting floor grid members to fit against abutting wall areas; 6) installing grout strip members in the floor grid members; 7) inserting cushion pad members between the grout strip members; 8) placing the tile setter tool member between the grid strip members; 9) inserting and moving a floor tile member into the tile setter tool member; 10) removing the tile setter tool member; and 11) repeating steps 8)–11), inclusive, to install each floor tile member. In a second embodiment, the grout receiving grooves are replaced with grout receiving projections and the grout strip members are replaced with grout strip assemblies.

29 Claims, 5 Drawing Sheets

METHOD OF FLOOR CONSTRUCTION WITH A GRID SYSTEM

This application is a Continuation-In-Part application of application Ser. No. 08/659,333 filed Jun. 6, 1996, now abandoned.

PREFERRED EMBODIMENT OF THE INVENTION

In one preferred embodiment of this invention, a method of floor construction with a grid system is provided to achieve a completed construction of a floor assembly with use of various sizes and shapes of tile members, wood members, marble members, or other materials to create a floating, non-adhesive floor installation installed without adhesive and can be readily relocated if so desired.

The method of floor construction with a grid system can be utilized to build a supporting tile floor on base support members within side walls in a given floor area such as a bathroom, kitchen, or the like.

The method of floor construction with a grid system utilizes 1) a plurality of floor grid members which can be interlocked to each other to form an overall large floor grid member assembly; 2) floor tile members of a size to interact within respective ones of the floor grid members and can be made of various types of materials such as ceramic, wood, marble, or the like; 3) cushion pad members of a size similar to the floor tile members and are to interact with the respective floor grid members; 4) grout strip members which can be provided as an elongated grout strip members or shortened grout strip members; and 5) a tile setter tool member operable to be usable between the grout strip members and with the respective floor tile members for ease of installation as will be noted.

Each floor grid member resembles a puzzle-like piece adapted to be interconnected with adjacent ones of the floor grid member to form the interlocked floor grid member assembly. Each floor grid member includes 1) a main support body; 2) grout receiving grooves extended parallel and transverse to each other; 3) male connector projections along two adjacent edges of the main support body; and 4) female lock receivers placed about the other two edges of the main support body.

The main support body has a central tile receiver section preferably of square shape but can be of rectangular or of any shape as will be noted. The main support body includes four tile half sections abutting respective outer walls of the central tile receiver sections and four tile quarter sections at outer corners thereof. Thus, each floor grid member is of a size to receive and support four floor tile members thereon.

The grout receiving grooves are preferably of ⅜" to ½" in width, approximately 1/16" in depth, and includes 1) first parallel groove sections; and 2) second parallel groove sections with each set of the first and second parallel groove sections extended perpendicular to each other.

Each male connector projection is of a shape and size to be interlocked with female lock receivers on other adjacent ones of the floor grid member as will be noted. More particularly, each male connector projection is provided with an anchor section integral with an outer lock section of triangular shape. The male connector projection is operable to be placed within and interlocked with the female lock receiver as will be explained.

The female lock receiver is provided with an entrance section integral with a main lock section. The main lock section is of a triangular shape so as to receive the lock section of the male connector projection therein when in a locked condition similar to interlocking of puzzle pieces.

The floor tile members can be of any size and shape such as triangular, rectangular, and square. It would be required that the floor grid members be constructed as to receive respective ones of the particular shape of the floor tile members used therewith.

Each floor tile member has a top wall, a bottom wall, and an outer side walls and of a size and shape to be received within the central tile receiver section of the main support body of the floor grid member.

Each cushion pad member is of a size substantially identical to the floor tile members and operable to provide a cushion and sound absorbing effect when in the assembled condition as will be noted. Each cushion pad member has a top wall section, a bottom wall section, and outer side wall sections.

The grout strip members are provided with the elongated strip members which may be 8' to 12' in length and the shortened grout strip members, which may be 4" to 12" in length are operable to transverse the area between the elongated grout strip members. The shortened grout strip members would be substantially equal to the actual width of an outer side wall of the floor tile members as will be noted. Each grout strip member has a top outer surface, a bottom outer surface, and side wall surfaces.

The bottom outer surface is provided with an adhesive layer which, in turn, has a cover sheet which will be removed to expose the adhesive layer during floor construction as will be explained.

Each grout strip member resembles an insulation strip preferably constructed of a foam material and having the top outer surface which can be colored, white, gray, black or any particular color.

Each grout strip member resembles an insulation strip material that is presently utilized to insulate around windows and doors. The top outer surface is preferably constructed of a durable material which will resemble an outer surface of normal grout material which has previously been utilized in permanent setting of a tile floor in a certain area such as bathrooms and kitchens.

The tile setter tool member is generally of square shape (if used with square floor tile members) in order to conform to the particular type of floor tile members being used. The tile setter tool member can be constructed of a metal material such as aluminum, stainless steel, or a rigid plastic material.

Each tile setter tool member includes 1) a main tool body having upper edges; 2) handle members secured to the upper edges; and 3) a rigid peripheral upper section integral with a flexible bottom section. The flexible bottom section is created by having a comer slit section at each of the lower four corners therein.

The flexible bottom section has outer peripheral lower edges which are adapted to be biased inwardly and then moved outwardly on placing of a floor tile member between the main tool body as will be explained.

The method of floor construction with a grid system of this invention first requires that there be a certain floor area, usually partially enclosed by vertical side walls, and having sufficient base support members thereunder.

The method of floor construction with a grid system of this invention involves the following steps:

1) installing a sufficient sub-floor at the floor area in which the floor is to constructed such as with the base support members;

2) laying out a plurality of floor grid members to cover the desired floor area to be created;

3) interlocking adjacent ones of the floor grid members to cover the floor area to achieve a floor grid member assembly;

4) moving the interlocked floor grid members in the floor grid member assembly around the floor area being covered to minimize the required number of floor grid members and cushion pad members to be cut to cover the entire floor area;

5) cutting floor grid members in order to fit against abutting side wall areas, appliances, and the like in order to completely cover the floor area;

6) installing elongated grout strip members into parallel spaced grout receiving grooves in the interlocked floor grid members after removing the protective cover sheet so as to adhesively lock the elongated grout strip members into first parallel grout sections in the floor grid members;

7) cutting grout strip members into proper ones of the shortened grout strip members to cover space between the parallel elongated grout strip members;

8) installing the shortened grout strip members into the grout receiving grooves between the elongated grout strip members after removing the protective sheet therein so as to adhesively mount them within respective second parallel groove sections in the floor grid members;

9) inserting respective ones of the cushion pad members between the normally square areas between the elongated grout strip members and the shortened grout strip members;

10) placing the tile setter tool member within a square area created by the floor grid member assembly and against a cushion pad member therein;

11) inserting a floor tile member into the tile setter tool member and moving it downwardly in a plane parallel to the floor area and the cushion pad member;

12) holding the floor tile member inserted within the tile setter tool member against the cushion pad member mounted therein;

13) expanding a lower portion of the tile setter tool member outwardly by the inserted floor tile member which compresses adjacent abutting portions of the grout strip members;

14) removing the tile setter tool member from about the floor tile member which allows the surrounding peripheral grout strip members to expand and hold the inserted floor tile member snugly in place;

15) repeating steps 10)–14), inclusive, for each floor tile member to be inserted between the grout strip members until the entire floor area has been covered;

16) cutting the floor tile members and associated cushion pad members to size where required to fit about outer peripheral edges of the floor grid member assembly;

17) taking the cut floor tile members and respective cut cushion pad members and mounting about the outer peripheral edges of the floor grid member assembly as so required; and 18) cleaning up the area, removing tools, cut tile members, etc.

In a second embodiment of this invention as shown in FIGS. 10–13, an altered floor grid member is used with a specially designed grout strip assembly in a second method of floor construction with a grid system. The floor grid member is provided with adjacent grout receiving projections operable to receive and anchor a portion of the grout strip assembly therein.

Each grout strip assembly is of a Greek cross shape including grout strip legs extended radially from a central point and having a top grout surface and a laterally extended anchor connector member.

The anchor connector member includes a support section integral with a blade type anchor V-section. The anchor V-section is operable to be inserted and secured between the adjacent, spaced grout receiving projections.

Outer ends of the respective grout strip legs are formed with a male connector end or a female connector end so that abutting, adjacent ends of the grout strip legs of abutting ones of the grout strip assemblies are snapped together in a dovetail manner to achieve a rigid connection therebetween.

The method of construction with the second embodiment is as previously described for the first embodiment with the floor tile members, the tile setter tool member, and the cushion pad members if used to achieve the final, assembled floor assembly.

OBJECTS OF THE INVENTION

One object of this invention is to provide a method of floor construction with a grid system utilizing a plurality of interconnected floor grid members to produce a floor grid member assembly operable within a certain floor area to construct an installed floor area defining a floating, non-adhesive floor installation process whereupon the installation can be readily and selectively disassembled, removed, and reused.

Another object of this invention is to provide a method of floor construction with a grid system basically using four steps being 1) setting in an interconnected plurality of floor grid members which can be snapped together similar to a puzzle which creates a plurality of normally square areas to receive floor tile members therein; 2) sticking grout strip members within grooves in the floor grid member assembly to achieve a foam grout installation; 3) placing a respective cushion pad member within the square areas formed by the floor grid member assembly; and 4) setting respective floor tile members in the square areas between the grout strip members to achieve a final tile floor construction.

One other object of this invention is to provide a method of floor construction with a grid system which involves steps for creating a floating, non-adhesive floor installation which has many advantages over the prior art methods of floor construction being 1) no need for additional sub-flooring to beef up a common floor to prevent prior art grout from cracking; 2) no need for additional floor joists to beef up the common floor to prevent the prior art grout from cracking; 3) no need to break out floor tile members that don't adhere properly by the prior art methods of construction; and 4) that an average homeowner can install floor tile members without concern for loosening tiles being properly installed on utilizing the method steps of this invention.

A further object of this invention is to provide a method of floor construction with a grid system whereupon the grid system has a plurality of interconnected floor grid members to form a floor grid member assembly; utilizing cushion pad members to receive floor tile members thereon; having mounted about the periphery of the floor tile members, grout strip members of foam construction; and utilizing a tile setter tool member to aid in placing the floor tile members between the grout strip members to achieve compression of the grout strip members in the final completed floor assembly.

One further object of this invention is to provide a method of floor construction with a grid system utilizing 1) a plurality of floor grid members to be interconnected to each other to form a floor grid member assembly; 2) a plurality of floor tile members to be placed selectively into normally square areas within the floor grid member assembly; 3) cushion pad members to be placed under respective floor tile members; 4) grout strip members, being elongated and shortened, to be placed within grout receiving grooves in the floor grid members to achieve the square areas between the grout strip members to receive a respective cushion pad member and a floor tile member therein; and 5) a specially designed tile setter tool member operable to readily install a respective floor tile member within the square areas between the grout strip members in an efficient and effective manner.

Still, one other object of this invention is to provide a method of floor construction with a grid system achieving a floating, non-adhesive floor installation which is reusable; is economical to manufacture; does not require skilled labor for ease of installation; provides for the easy removal of the tile members therein if one desires to utilize them in a different location which is beneficial to people who are renting an apartment, house, and the like; and is substantially maintenance free.

Various other objects, advantages, and features of the invention will become apparent to those skilled in the art from the following discussion, taken in conjunction with the accompanying drawings, in which:

FIGURES OF THE INVENTION

Figure 1:
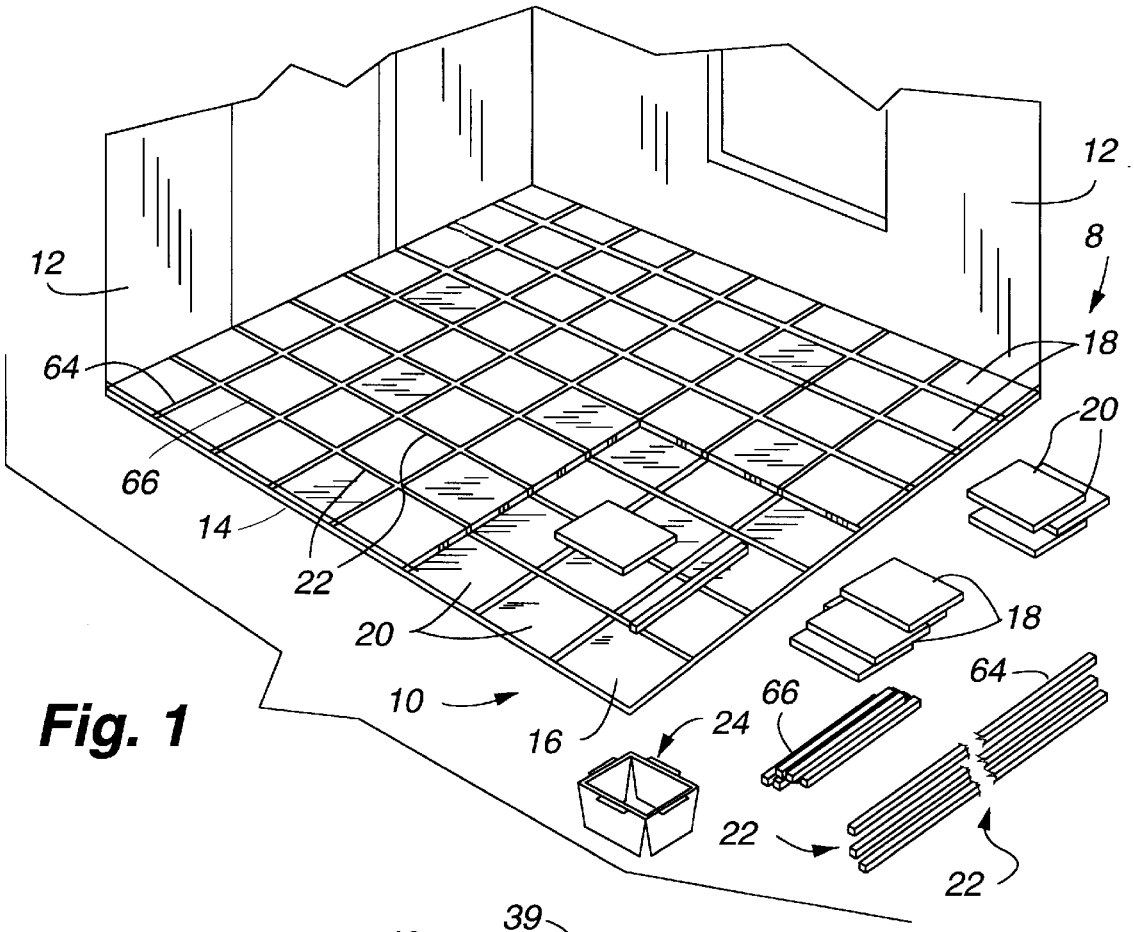
FIG. 1 is a fragmentary perspective view of a room area having a floor area to be covered with floor cover members utilizing the method of floor construction with a grid system of this invention illustrating various elements need being floor grid members, floor tile members, cushion pad members, grout strip members, and a tile setter tool member.

The following is a discussion and description of preferred specific embodiments of the method of floor construction with a grid system of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a method of floor construction with a grid system of this invention, indicated generally at 8, is utilized on a floor area 10 to have a tile floor installed thereon. The floor area 10 is between peripheral side walls 12 and having a main base support flooring or base support members 14 thereon.

Prior to use of the method of floor construction with a grid system 8, a sufficiently rigid base support flooring 14 must be present when using the prior art methods of ceramic tile floor construction to prevent setting of the tile members and cracking of the prior art grout. The invention herein is utilizing a special type of foam grout which is not subject to cracking.

As shown in FIG. 1, the method of floor construction with a grid system 8 includes a plurality of elements to be utilized therewith being 1) a plurality of floor grid members 16 to be interconnected to each other; 2) a plurality of floor tile members or floor cover members 18 which can be of various sizes and shapes as will be explained; 3) a plurality of cushion pad members 20 which can be constructed of a felt or other cushioning and sound-absorbing type material and being of a size and shape substantially identical to the floor tile members 18; 4) grout strip members 22 to be utilized with the floor grid member 16 to achieve a grout appearance about an outer periphery of respective floor tile members; and 5) a unique tile setter tool member 24 to aid in the method of floor construction with a grid system 8 as will be explained.

Figure 2:
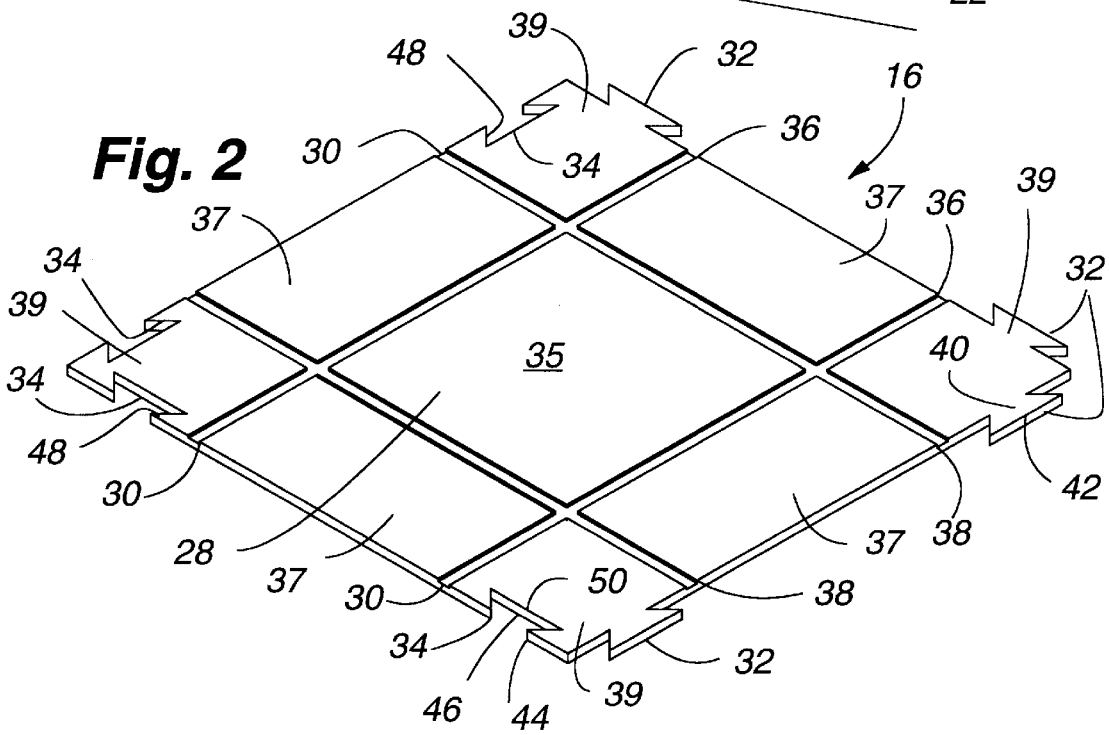
FIG. 2 is a perspective view of a floor grid member used with the method of floor construction with a grid system of this invention.
Figure 3:
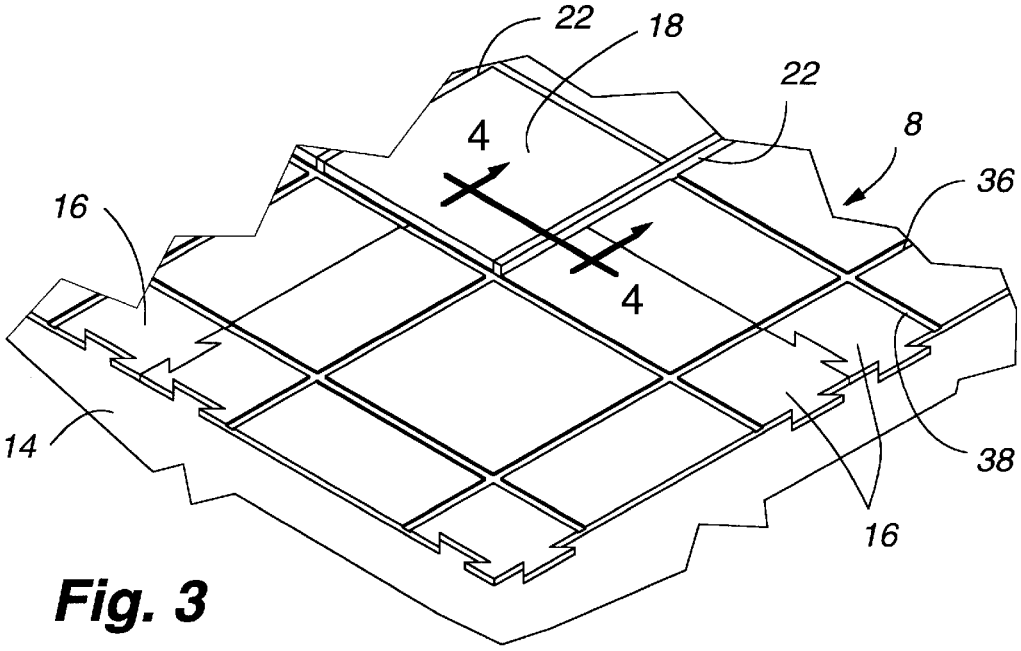
FIG. 3 is a fragmentary perspective view showing interlocking features of the floor grid members of this invention.
Figure 4:
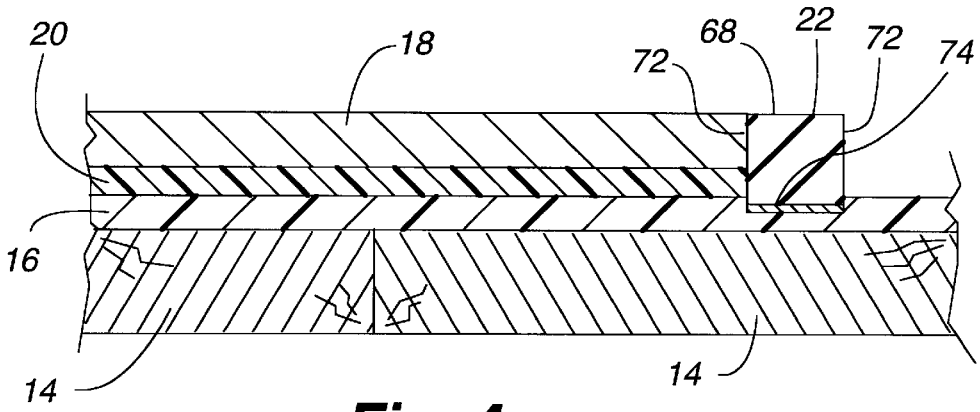
FIG. 4 is an enlarged fragmentary sectional view taken along line 4—4 in FIG. 3.
Figure 7:
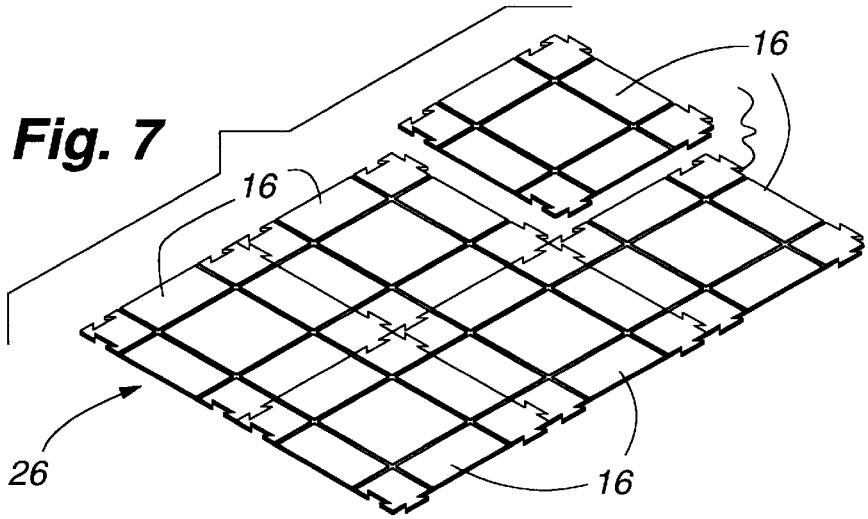
FIG. 7 is a perspective view showing a method step of interlocking a plurality of floor grid members.
Figure 8:
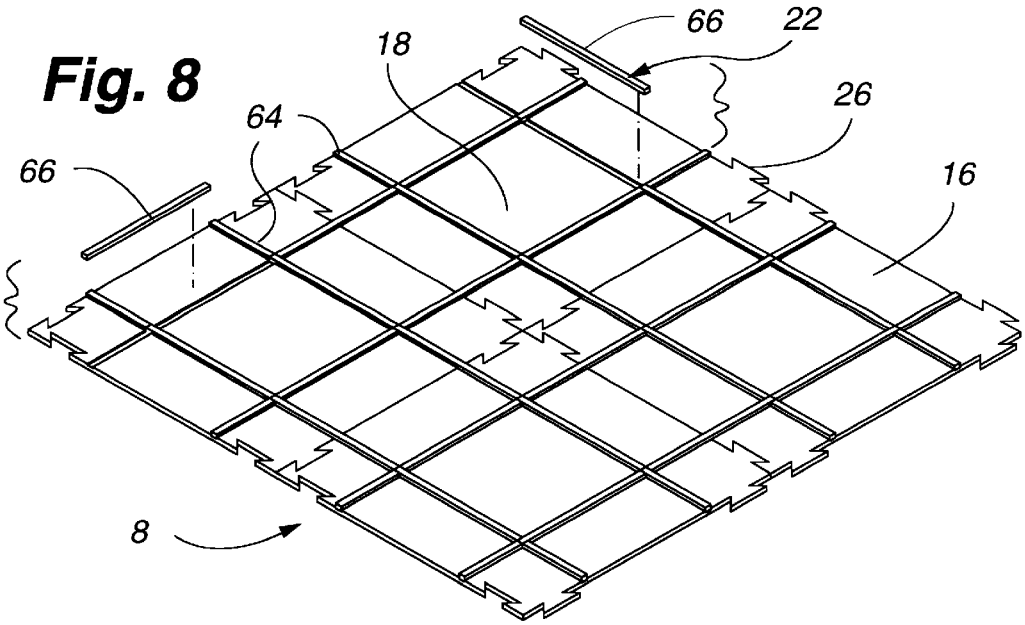
FIG. 8 is a perspective view illustrating installation of grout strip members in another method step of this invention.

The floor grid member 16, as noted in FIG. 2, is to be interconnected to additional floor grid members 16 to form a floor grid member assembly 26 as noted in FIG. 7. Each floor grid member 16 includes 1) a main support body 28; 2) grout receiving grooves 30; 3) male connector projections 32; and 4) female lock receivers 34.

Figure 9:
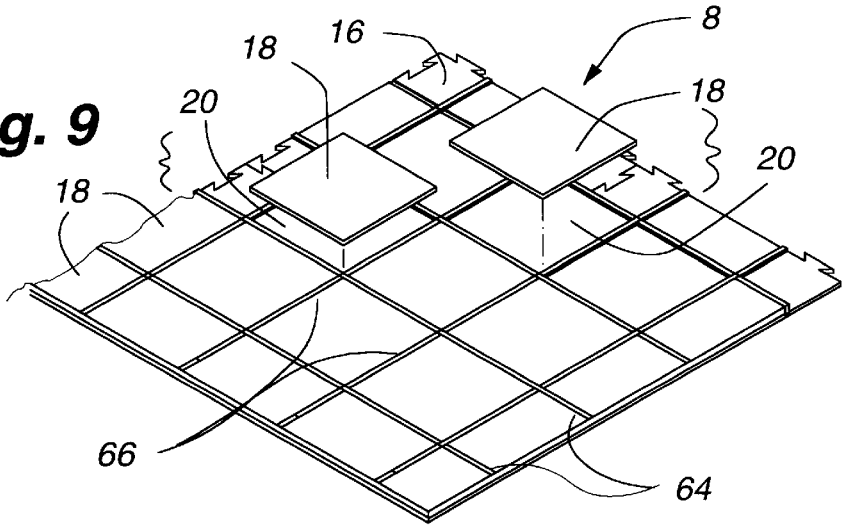
FIG. 9 is a perspective view illustrating final method steps of installing floor tile members over cushion pad members and between installed grout strip members.

The main support body 28 is provided with 1) a central tile receiver section or cover receiver area 35; 2) four tile half sections 37; and 3) four tile quarter sections 39. Each floor grid member 16 has a total of four complete square sections or cover reciever areas to receive the floor tile members 18 therein when assembled as noted in FIG. 9.

The grout receiving grooves 30 are formed with first parallel groove sections 36 and second parallel groove sections 38 which are directed perpendicular to the first parallel groove sections 36.

Each floor grid member 16 has four of the male connector projections 32 and four of the female lock receivers 34. Each male connector projection 32 includes an anchor section 40 integral with a lock section 42 being of generally triangular shape.

Each female lock receivers 34 has an entrance section 44 integral with a main lock section 46. The main lock section 46 is adapted to receive the lock section 42 therein in a puzzle-like engagement as shown in FIG. 7.

The main lock section 46 has side walls 48 leading into an end wall 50. The side walls 48 and end wall 50 are adapted to receive and lock the lock section 42 of a respective male connector projection 32 therein to prevent lateral, horizontal movement.

The floor tile members 18 can be of any shape such as triangular, square, or rectangular but normally square sizes would be utilized. The floor tile members 18 can be constructed of a ceramic material, marble plate, wooden parquet, and any other type of material that is preferably waterproof. Each floor tile member 18 has a top wall 52, a bottom wall 54, and outer peripheral side walls 56.

The cushion pad member 20 is of a size substantial identical or slightly smaller than the floor tile members 18. The cushion pad member 20 is preferably constructed of a felt material or the like to provide a cushion and soundproofing to the floor tile members 18 when being walked upon in the assembled condition as will be explained. Each cushion pad member 20 is provided with a top wall section 58, a bottom wall section 60, and outer peripheral side wall sections 62.

Figure 5:
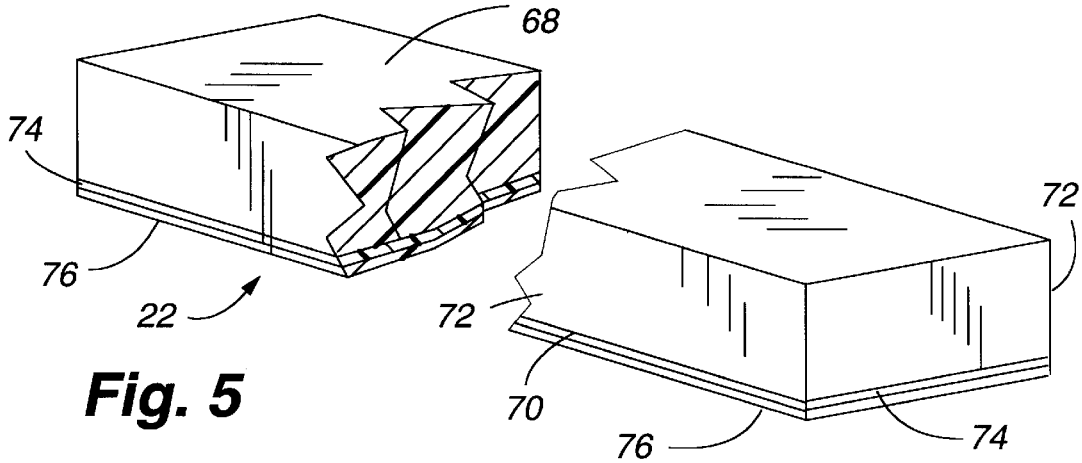
FIG. 5 is an enlarged foreshortened view of an elongated grout strip member of this invention.

As noted in FIG. 5, the grout strip members or spacer strip members 22 include elongated grout strip members 64 which may be cut to shorter grout strip members 66 (see FIG. 1). Each grout strip member 22 has a top outer surface 68, a bottom outer surface 70, and spaced parallel side wall surfaces 72.

The bottom outer surface 70 is provided with an outer adhesive layer 74 protected by a cover sheet 76 which is removed to expose the adhesive layer 74 in a process step as will be explained.

The grout strip members 22 resemble insulation strips utilized about doors and windows to seal cracks and the like during a weather sealing operation. The top outer surface 68 can be of various colors such as gray, white, and black but can be manufactured in any color as so desired. In other words, a light blue color for the top outer surface 68 of the grout strip members 22 might be used when utilizing a blue floor tile member 18.

Figure 6:
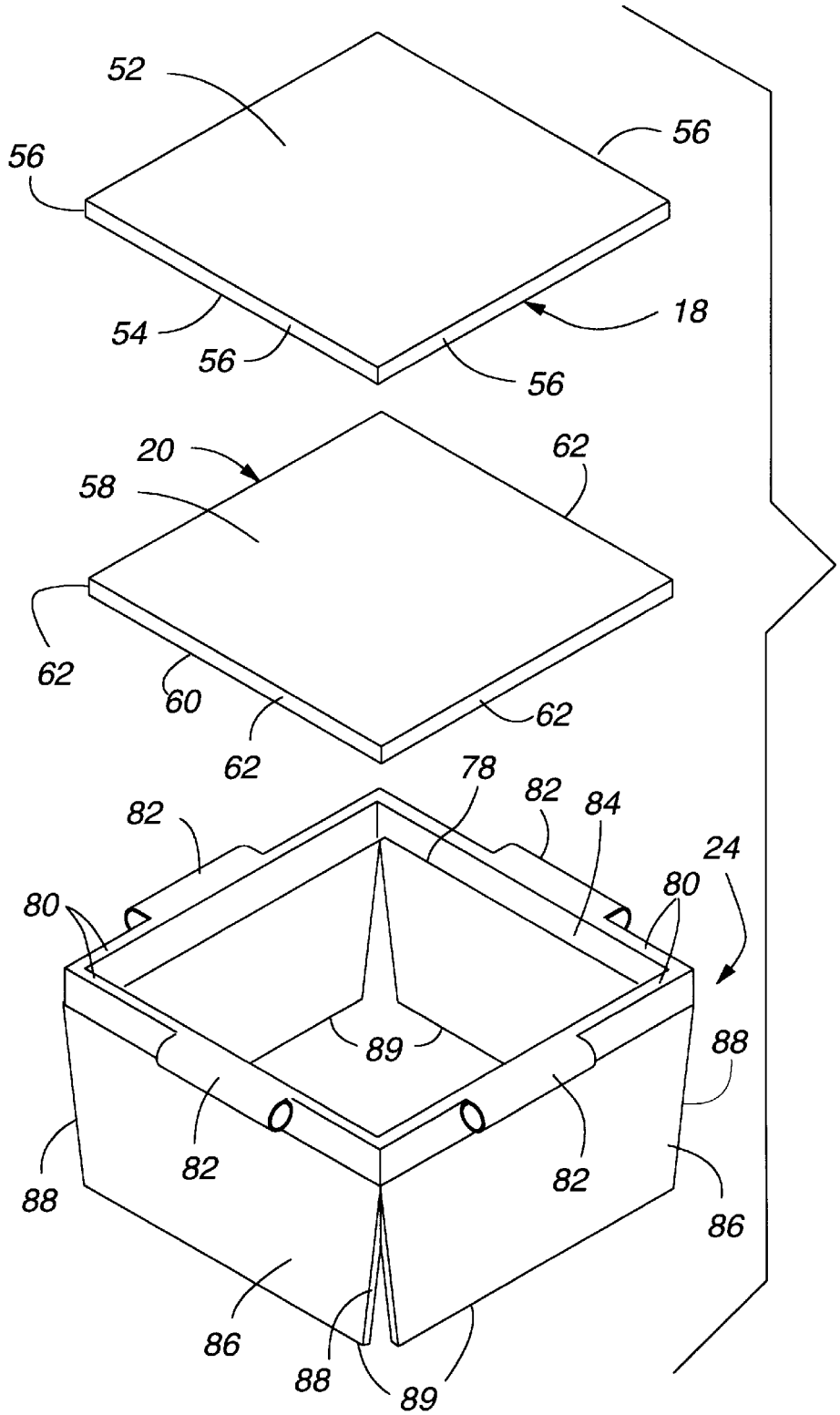
FIG. 6 is a perspective view showing the installation of a floor tile member with the tile setter tool member of this invention.

As noted in FIG. 6, the specially designed tile setter tool member 24 includes a main tool body 78 having 1) upper edges 80; 2) four handle members 82 on the upper edges 80; 3) a rigid upper section 84; 4) a flexible bottom section 86 integral with the rigid upper section 84; 5) corner slit sections 88 in the bottom section 86 to cause its flexibility; and 6) lower edges 89 to be placed on or about the cushion pad member 20 during a floor construction method step as will be explained.

The tile setter tool member 24 is operable so that the lower edges 89, due to the corner slit sections 88 at each comer thereof, are allowed to expand outwardly when receiving a respective floor tile member 18 thereagainst in a manner to be noted. The tile setter tool member 24 can be constructed of a lightweight material being of aluminum or a plastic material.

Figure 10:
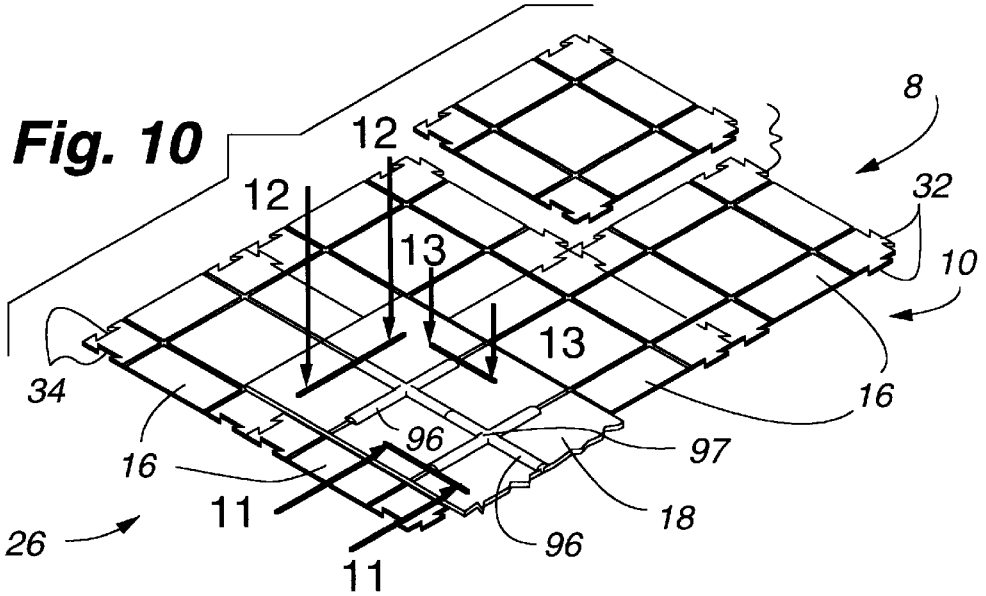
FIG. 10 is a perspective view similar to FIG. 7 with installation of floor grid members, floor tile members, and grout strip assemblies of a second embodiment of this invention.

In a second embodiment of this invention as shown in FIG. 10, a method of floor construction with a grid system 8 is utilized in the same previously described floor area 10 to produce a floor grid member assembly 26 therein.

The new method of floor construction with a grid system 8 includes 1) a floor grid member 16; 2) a plurality of the floor tile members 18; 3) selective use of the cushion pad members 20; 4) a newly designed grout strip member or assembly 96 to be used with the floor grid members 16; and 5) use of the tile setter tool member 24 if so desired.

Figure 11:
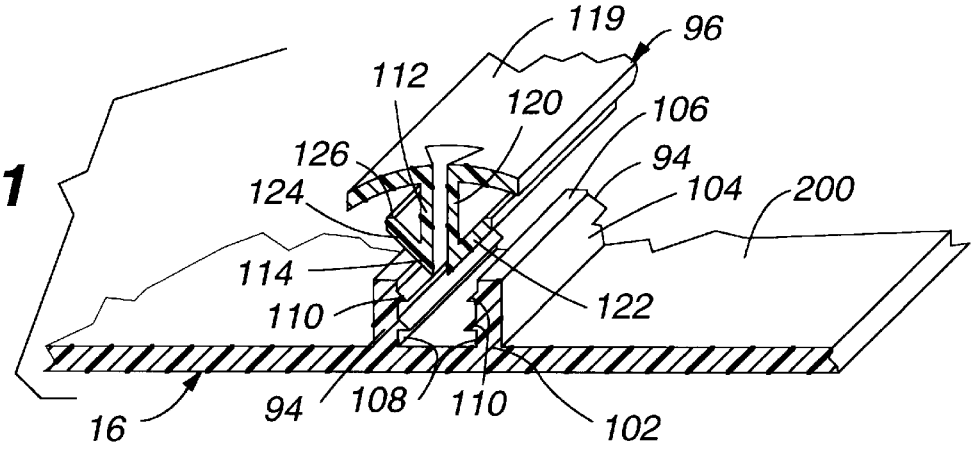
FIG. 11 is an enlarged fragmentary sectional view taken along line 11—11 in FIG. 10.
Figure 12:
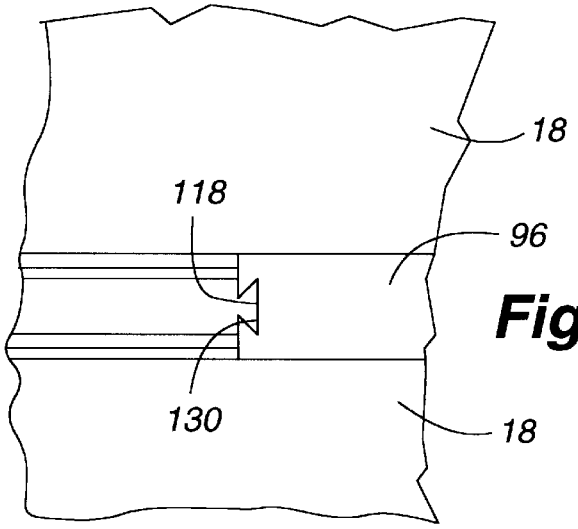
FIG. 12 is an enlarged fragmentary sectional view taken along line 12—12 in FIG. 10.
Figure 13:
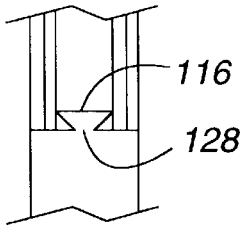
FIG. 13 is an enlarged fragmentary sectional view taken along line 13—13 in FIG. 10.

As best shown in FIG. 11, each floor grid member 16 includes 1) a main support body 28 having a pair of parallel, spaced, adjacent grout receiving areas or projections 94 facing each other; 2) male connector projections 32; and 3) female lock receivers 34.

The male connector projections 32 are selectively connected to the female lock receivers 34 in a dovetail manner as previously described in the first embodimnent.

The main support body 28 is provided with a central tile receiver section 35 surrounded by tile half sections 37 and tile quarter sections 39. The central half and quarter tile receiver sections 35, 37, 39 are divided into these respective areas by the spaced parallel grout receiving projections 94 as noted in FIGS. 10 and 11.

Each grout receiving projection 94 includes 1) a bottom wall 102; 2) an outer wall 104; 3) a top wall 106; and 4) an inner wall 108 having a pair of spaced parallel V-shaped retainer projections 110 extended an axial length of the grout receiving projections 94. Each retainer projection 110 is operable to engage a similar shaped one-way retainer or blade member on the grout strip assemblies 96 as will be explained.

The cushion pad members 20 are an optional feature of the second embodiment in the method of floor construction with a grid system 8 whereupon it may or may not be utilized therewith to achieve a desired cushioning effect.

Each grout strip assembly 96 is of a Greek cross shape having a central portion 97 with lateral projections therefrom of equal length. Each grout strip assembly 96 includes 1) a plurality of grout strip legs or projections 112 extending from the central portion 97; 2) anchor connector members 114; 3) outer ends of a pair of the grout strip legs 112 are provided with male connector ends 116; and 4) another pair of the outer ends of a second pair of the grout strip legs 112 are formed with female connector ends 118.

Each grout strip leg 112 is provided with an arcuate top grout surface 119 which is of a desired selected color and being a top smooth or textured surface resembling of a bead of grout material when in the assembled condition with a floor tile member 18.

Each anchor connector member 114 is provided with a support section 120 integral at an outer end thereof with an anchor V-section 122 which extends the length of each grout strip leg 112. Each anchor connector member 114 is operable to be engaged with respective grout retaining members 98 in the grout receiving projections 94 of respective floor grid members 16 as will be explained.

Each anchor V-section 122 is provided with a blade portion 124 centrally integral with each other and an outer end of the support section 120. Each blade portion 124 includes an outer pointed anchor end 126 engageable with the retainer projections 110 on the grout retaining members 98 to achieve a one-way anchor.

Each male connector end 116 is provided with an anchor tenon projection 128 extended from an outer end of two of the grout strip legs 112 on each of the grout strip assemblies 96.

Each female connector end 118 on other outer ends of two of the grout strip legs 112 of the grout strip assembly 96 is provided with an anchor mortise recession 130 operable to receive and be interlocked with an adjacent anchor tenon projection 128 when assembled.

The male connector end 116 and the female connector end 118 are operable to be interlocked in a known dovetail manner as the anchor tenon projection 128 is a projecting member for insertion into the anchor mortise recession 130 to provide the dovetail connection therebetween to prevent axial and lateral movement when interconnected relative to each other (FIG. 1).

The main purpose of the tile setter tool member 24 is that it can be placed within an inner periphery of, for example, a central tile receiver section 35 of a floor grid member 16 during the assembly process. More specifically, the lower edges 89 of the flexible bottom section 86 are to be placed between the grout strip members 22. An inserted floor tile member 18 is operable to provide compression of the adjacent grout strip members 22 in the assembly procedure. This compression of the adjacent grout strip members 22 is very difficult to do without use of the tile setter tool member 24.

USE AND OPERATION OF THE INVENTION

In the use and operation of the method of floor construction with a grid system 8 of this invention, it is obvious that we first define a floor area 10 within the side walls 12 and having the base support flooring or base support member 14 already mounted thereon or placed thereon during a new construction. The base support members 14 may be of a ¾" or 1" thick plywood construction placed on a plurality of parallel spaced floor joists (not shown).

In the method of floor construction with a grid system 8 of this invention, the following method steps are noted:

1) installing a sufficient sub-floor in the floor area 10 to receive a floor construction thereon;
2) laying out a plurality of the floor grid members 16 in a sufficient number to cover the floor area 10;
3) interlocking the plurality of floor grid members 16 to form the floor grid member assembly 26 to cover the floor area 10;
4) moving the interlocked floor grid members 16 formed into the floor grid member assembly 26 around the floor area 10 to minimize the required number of floor grid members 16 to be cut to cover the entire floor area 10;
5) cutting floor grid members 16 in order to fit against abutting wall areas, appliances, and the like in order to completely cover the floor area 10;
6) installing the elongated grout strip members 64 into spaced parallel first parallel groove sections 36 after removing the cover sheet 76 to expose the adhesive layer 74;
7) cutting grout strip members 22 or elongated grout strip members 64 into the shortened grout strip members 66 to cover space between the parallel elongated grout strip members 64 installed in step 6) above;
8) installing the shorter grout strip members 66 into the second parallel groove sections 38 between the elongated grout strip members 64;
9) installing respective cushion pad members 20 within the normally square areas between the installed grout strip members 22;
10) placing the tile setter tool member 24 within the square areas defined by the grout strip members 22 and placed against or about a cushion pad member 20 installed in step 9) above;
11) inserting a floor tile member 18 into the open, upper end of the tile setter tool member 24 and moving subject floor tile member 18 downwardly in a plane parallel to the floor area 10 and the cushion pad member 20;
12) holding the floor tile member 18 with a user's one hand against the cushion pad member 20;
13) expanding the flexible bottom section 86 and lower edges 89 of the tile setter tool member 24 which compresses adjacent portions of the grout strip members 22;
14) removing the tile setter tool member 24 with the use of the user's other hand from about the floor tile member 18 which allows the surrounding peripheral grout strip members 22 to expand and hold the floor tile member 18 snugly in place;
15) repeating the above steps 10)–14), inclusive, for each floor tile member 18 to be installed;
16) cutting the floor tile members 18 and a cushion pad member 20 to be associated respectively therewith to size in order to fit about the outer peripheral edges of the floor grid member assembly 26 and completely cover the floor area 10;
17) taking the cut floor tile members 18 and cushion pad members 20 from above step 16) and mounting about the outer peripheral edges of the floor grid member assembly 26 to completely cover the floor area 10; and
18) cleaning up the area, removing cut and unusable floor tile members 18 and cushion pad members 20, remove the tools, and generally finish the method of floor construction 8.

The method steps 10)–14), inclusive, using the tile setter tool member 24 can be replaced with the user inserting each floor tile member 18 into the square areas between the grout strip members 22. The floor tile member 18 is then shifted about until the bottom wall 54 rests on the top wall section 58 of the adjacent cushion pad member 20. This causes the adjacent portions of the grout strip members 22 to be compressed and the floor tile member 18 is held snugly in place. This method step is repeated until all of the floor tile members 18 are installed within the floor grid member assembly 26.

The floor grid member 16 is preferably of a plastic material and preferably of a ⅛" thickness and having the grout receiving grooves 30 approximately 1/16" in depth. The central tile receiver section 35 is preferably a 4"×4" or 1'×1' size. The grout receiving grooves 30 can be ⅜" or ½" in width to receive the grout strip members 22 of identical width on each floor grid member 16 therein.

The male connector projections 32 and the female lock receivers 34 can be of various irregular shapes. The use of four each of the male connector projections 32 and the female lock receivers 34 will provide a rigid interconnection of adjacent floor grid members 16 to form the floor grid member assembly 26 as noted in FIG. 7.

The floor grid members 16 can be adapted to used with various shapes of tile such as triangular, square, circular, or rectangular.

The floor tile members 18 can be of various sizes, shapes, and thickness as the floor grid members 16 can be designed to be utilized with the various sizes, shapes, and types of floor tile members 18.

The tile setter tool member 24 can be changed in sizes and designs to accommodate rectangular or square floor tile members 18 to assist in the installation thereof within the floor grid member assembly 26.

In the method steps of construction utilizing the second embodiment of this invention as shown in FIGS. 10–13, the initial method steps as previously described are as follows:

1) installing a sufficient sub-floor in the floor area 10 to receive a floor construction thereon;
2) laying out a plurality of the floor grid members 16 in a sufficient number to cover the floor area 10;
3) interlocking the plurality of floor grid members 16 to form the floor grid member assembly 26 to cover the floor area 10;
4) moving the interlocked floor grid members 16 formed into the floor grid member assembly 26 around the floor area 10 to minimize the required number of floor grid members 16 to be cut to cover the entire floor area 10; and 5) cutting floor grid members 16 in order to fit against abutting wall areas, appliances, and the like in order to completely cover the floor area 10.

On having the floor grid members 16 of the second embodiment (FIGS. 11 and 12) interconnected through the male connector projections 32 and the female lock receivers 34, the next method step is to insert the cushion pad members 20, if so desired, between the various tile receiving areas of the grout receiving projections 94. At this time, the tile setter tool member 24 may be utilized as deemed necessary but may not be needed to be utilized due to the vertical spacing of the grout receiving projections 94 to define the receiving areas to support the respective cushion pad members 20 and the floor tile members 18 therebetween.

The next method step for the operator would be to insert the grout strip assemblies 96 between abutting four corners of the floor tile members 18 as noted in FIG. 10. The respective grout strip assemblies 96 are to be pressed downwardly in a snapped-in fashion whereupon the retainer projections 110 on the grout receiving projections 94 are operable to be engaged with the blade portions 124 on the anchor V-sections 122 of the anchor connector members 114 in a one-way locking relationship.

Depending on thickness of the floor tile members 18 and whether a cushion pad member 20 is utilized, the upper retainer projections 110 on the grout receiving projections 94 will engage the pointed anchor end 126 of the blade portions 124 of the anchor V-sections 122. This achieves a compression force from the top wall 106 of the grout receiving projections 94 to provide a downward bias force to hold the respective floor tile members 18 against the respective main support bodies 28.

On attaching further ones of the grout strip assemblies 96, various ends of the male connector ends 116 or the female connector ends 118 are operable to engage and connect to each other as noted with use of the two grout strip assemblies 96 in FIG. 10.

The connection between the retainer projections 110 on the grout receiving projections 94 and the pointed anchor ends 126 on the anchor V-sections 122 of the grout strip assemblies 96 has been described as a "one-way anchor or locking relationship". However, due to flexibility of the retainer projections 110 and the anchor V-sections 122, the respective grout strip assemblies 96 can be removed for repair, replacement, or removal of the floor tile members 18 and the cushion pad members 20 as desired for further usage.

It is noted that the method of floor construction with a grid system 8 can be used with the floor grid members 16 and grout strip members or assemblies 96 against a wall area to attach floor tile members 18 thereagainst such as in a bathroom tub and shower area or to achieve a decorative wall.

The procedure of adding the floor tile members 18 with or without the cushion pad members 20 into the areas of a size of a central tile receiver section 35 is then continued until an entire floor grid member assembly 26 is achieved similar to that described for the first embodiment of the method of floor construction with a grid system 8 of this invention.

The method of floor construction with a grid system 8 of this invention allows for construction of a floating, non-adhesive floor installation whereupon nothing needs to be securely fastened to the sub-flooring. However, it may be desirable to utilize a few nails to anchor the floor grid member assembly 26 to the base support members 14 prior to proceeding with installation of the cushion pad members 20 and the floor tile members 18.

Further, the method of floor construction with a grid system of this invention can be 1) normally installed in an efficient manner, not requiring skilled labor to do so; 2) used with economical floor grid members having the grout strip members therein which does not require the skilled labor of a floor installer and mixing and use of prior art grout material; 3) used to achieve an installed floor system which can be readily removed and reusable in a different floor area; and 4) used to achieve an installed floor system with a specially designed tile setter tool member to simplify the floor construction process, not requiring one skilled in this area.

The method of floor construction with a grid system of this invention allows the average homeowner, whether owning a home, renting an apartment, or renting a house, to install a completed floor installation without concern for loosening tiles being improperly installed.

While the invention has been described in conjunction with preferred specific embodiments thereof, it will be understood that this description is intended to illustrate and not to limit the scope of the invention, which is defined by the following claims:

We claim:

1. A method of floor construction with a grid system using floor grid members, floor tile members, cushion pad members, and grout strip members, comprising the following steps:

a) placing a floor grid member on a base support member;

b) said floor grid member having spaced grout receiving groove sections;

c) connecting grout strip members to said grout receiving groove sections in said floor grid member forming a tile area therebetween operable to receive a floor tile member therein; and d) inserting a floor tile member in said tile area between said grout strip members to present said tile member held in place by said grout strip members;

whereby said floor tile member is not held by adhesive to achieve a floating floor installation and said floor tile member can be readily removed and used elsewhere.

2. A method of floor construction with a grid system as described in claim 1, including:

before step c), placing a cushion pad member on said floor grid member thereby achieving a cushioning and a noise reduction feature to the overall combination.

3. A method of floor construction with a grid system as described in claim 1, including:

a) after step a), interconnecting a plurality of said floor grid members on said base support member to completely cover a floor area to be covered; and repeating steps b) through d) for each said floor grid member.

4. A method of floor construction with a grid system as described in claim 1, including:

having a plurality of said grout receiving groove sections in said floor grid member; and securing said grout strip members in said grout receiving groove sections by an adhesive material.

5. A method of floor construction with a grid system as described in claim 1, including:

having an entire area equivalent to four of said floor tile members on each of said floor grid members.

6. A method of floor construction with a grid system using floor grid members, floor cover members, cushion pad members, and spacer strip members in order to construct a support floor in a given floor area, comprising the following steps:

a) interconnecting a plurality of floor grid members to achieve a primary support layer over the floor area;

b) connecting spacer strip members to grout receiving grooves in said floor grid members to form cover receiver areas of a size to receive a floor cover member therebetween; and c) inserting a respective said floor cover member in respective ones of said cover receiver areas between said grout receiving grooves having said spacer strip members mounted therein to cover the entire floor area;

whereby said floor cover members are held in place by said spacer strip members, not by an adhesive, and can be readily removed from said floor grid members to be replaced or used elsewhere.

7. A method of floor construction with a grid system as described in claim 6, including:

in conjunction with step b), connecting said spacer strip members to said floor grid members in said grout receiving grooves by an adhesive material.

8. A method of floor construction with a grid system as described in claim 6, including:

before step c), inserting a cushion pad member on said floor grid members to provide a cushioning and sound-absorbing effect.

9. A method of floor construction with a grid system as described in claim 6, including:

in conjunction with step c), compressing said spacer strip members on insertion of said floor cover member in respective ones of said cover receiver areas;

whereby each of said floor cover members are held snugly and firmly in place by said spacer strip members.

10. A method of floor construction with a grid system using interlocking floor grid members having grout receiving grooves thereon; a plurality of floor cover members; a plurality of cushion pad members; grout resembling strip members; and a tile setter tool member operable to create a floating, non-adhesive floor installation utilizing the following steps:

a) interconnecting a plurality of floor grid members collectively equal in size to a floor area to be covered;

b) moving said interconnected floor grid members, being a floor grid member assembly, about the floor area to minimize an amount of cutting of said floor grid members, floor cover members, and cushion pad members for fitting about outer peripheral edges of said floor grid member assembly to completely fill the floor area;

c) inserting grout resembling strip members into respective grout receiving grooves on said floor grid members;

d) placing a cushion pad member in respective areas between said grout resembling strip members; and e) inserting respective floor cover members on top of respective ones of said cushion pad members between said grout resembling strip members.

11. A method of floor construction with a grid system as described in claim 10, including:

a) in conjunction with step c), connecting said grout resembling strip members in said grout receiving grooves by an adhesive material.

12. A method of floor construction with a grid system as described in claim 10, including:

providing said grout resembling strip members being of a flexible, compressible foam material.

13. A method of floor construction with a grid system as described in claim 10, including:

before step e), placing a cover setter tool member between said grout resembling strip members defining a cover receiver area;

inserting a floor cover member into said cover setter tool member;

moving said floor cover member downwardly within said cover setter tool member which moves a lower portion of said cover setter tool member outwardly;

compressing adjacent portions of said grout resembling strip members against portions of said floor cover member contacting said cushion pad member; and removing said cover setter tool member from contact with said grout resembling strip members and said floor cover member;

whereby said floor cover member is held snugly and firmly in place by expansion of adjacent ones of said grout resembling strip members.

14. A floor construction, comprising:

a) a floor grid member having peripheral connector members to permit interlocking of adjacent ones of said floor grid members; and b) said floor grid member having grout receiving areas to receive grout strip members therein to define a floor cover receiver area therebetween.

15. A grid system as described in claim 14, wherein:

a) said peripheral connector members formed with male connector projections and female lock receivers operable to be engageable on adjacent abutting ones of said floor grid members so as to be interlocked.

16. A grid system as described in claim 16, wherein:

a) said grout receiving areas include first parallel groove sections and second parallel groove sections; and b) said first and second parallel groove sections extended perpendicular to each other and having said floor cover receiver area therebetween.

17. A grid system as described in claim 14, including:

a) a tile setter tool member having a flexible lower section of a size equal to an outer periphery of said floor cover receiver area adapted to receive a floor cover member therein.

18. A grid system as described in claim 17, wherein:

a) said lower section being flexible and movable outwardly by said floor cover member to compress said grout strip members.

19. A grid system as described in claim 14, wherein:

a) said grout receiving areas include a pair of parallel, adjacent grout receiving projections; and b) said grout strip members snapped into engagement with said grout receiving projections to hold a floor cover member against said floor grid member.

20. A grid system as described in claim 19, wherein:

a) said grout strip members of a cross shape to engage abutting comers of said floor cover member in an assembled condition to hold against said floor grid member;

b) said grout strip member includes an anchor connector members having a support section connected to an anchor V-section; and c) said anchor V-section engaged with said grout receiving projections to be securely anchored in the assembled condition.

21. A method of floor construction with a grid system using interlocking floor grid members having grout receiving projections thereon; a plurality of floor cover members; and grout resembling grout strip assemblies to create a floating, non-adhesive floor installation, utilizing the following steps:

a) interconnecting a plurality of floor grid members having floor cover receiving areas between grout receiving projections into a floor area to be covered;

b) moving said interconnected floor grid members, being a floor grid member assembly, about the floor area to minimize an amount of cutting of said floor grid members and floor cover members for fitting about outer peripheral edges of said floor grid assembly;

c) inserting respective said floor cover members in said floor cover receiving areas; and d) inserting grout resembling grout strip assemblies into respective said grout receiving projections on said floor grid members to achieve a completed floor grid member assembly.

22. A method of floor construction with a grid system as described in claim 21, including:

after step d), connecting outer abutting ends of said grout resembling grout strip assemblies by dovetail connections.

23. A method of floor construction with a grid system as described in claim 21, including:

providing said grout resembling grout strip assemblies of a flexible, compressible material and having an outer surface resembling a grout material.

24. A method of floor construction with a grid system as described in claim 21, including:

before step c), placing a floor cover setter tool member between said grout receiving projections defining said floor cover receiving areas therebetween;

inserting a floor cover member into said cover setter tool member;

moving said floor cover member downwardly within said floor cover setter tool member which moves a lower portion of said floor cover setter tool member outwardly;

moving adjacent portions of said grout receiving projections on said floor grid members by contact with said lower portion of said floor cover setter tool member; and removing said floor cover setter tool member from contact with said grout receiving projections and said floor cover member;

whereby said floor cover member is held snugly and firmly in place by expansion of adjacent ones of said grout receiving projections.

25. A method of floor construction with a grid system as described in claim 21, wherein:

inserting said grout resembling grout strips in respective ones of said grout receiving projections achieve a one-way anchor connection to hold said floor cover members against said floor grid members.

26. A method of floor construction with a grid system as described in claim 21, wherein:

during step d), contacting said grout resembling grout strip assemblies against said floor cover members to hold against movement in said floor cover receiving areas.

27. A method of floor construction with a grid system as described in claim 21, wherein:

a) during step a), interconnecting connector projections and lock receivers on adjacent ones of said floor grid members to form said floor grid member assembly.

28. A method of floor construction with a grid system as described in claim 21, including:

a) after step b), placing a cushion pad member between said grout receiving projections on said floor grid members to achieve a cushioning and a noise reduction feature to the overall combination.

29. A method of floor construction with a grid system as described in claim 28, including:

compressing said cushion pad members on insertion of said grout resembling grout strip assemblies in said grout receiving projections against said floor cover members.

* * * * *

UNITED STATES PATENT AND TRADEMARK OFFICE

CERTIFICATE OF CORRECTION

PATENT NO. : 5,806,270

DATED : September 15, 1998

INVENTOR(S) : Albert Solano, et al.

It is certified that error appears in the above-identified patent and that said Letters Patent is hereby corrected as shown below:

Column 14, line 57, after "members" insert --each--.

Column 14, line 63, after "members" insert --each--.

Signed and Sealed this

Sixth Day of April, 1999

*Attest:*

*Attesting Officer*

Q. TODD DICKINSON

*Acting Commissioner of Patents and Trademarks*